United States Patent [19]

Krick et al.

[11] 4,047,776

[45] Sept. 13, 1977

[54] CABINET CONSTRUCTION

[75] Inventors: Edward F. Krick, Phoenix; David E. MacLeod, Syracuse, both of N.Y.

[73] Assignee: Carrier Corporation, Syracuse, N.Y.

[21] Appl. No.: 644,272

[22] Filed: Dec. 24, 1975

[51] Int. Cl.[2] ..... A47F 5/08; F25D 23/12

[52] U.S. Cl. ..... 312/245; 312/246; 312/101; 62/263

[58] Field of Search ..... 312/245, 246, 247, 101; 62/263

[56] References Cited

U.S. PATENT DOCUMENTS

| | | | |
|---|---|---|---|
| 959,709 | 5/1910 | Buel, Jr. | 312/101 |
| 1,620,047 | 3/1927 | Van Valkenburg | 312/245 |
| 2,115,715 | 5/1938 | Kalischer | 62/263 |
| 2,115,720 | 5/1938 | Holmes | 312/245 |
| 2,275,295 | 3/1942 | Greenway | 62/263 |
| 2,729,529 | 1/1956 | Hoven et al. | 312/245 |
| 3,318,647 | 5/1967 | Bishop | 312/245 |
| 3,871,188 | 3/1975 | Vold et al. | 62/263 |
| 3,909,091 | 9/1975 | Tantillo | 312/245 |
| Re. 21,080 | 5/1939 | De Boer | 312/246 |

*Primary Examiner*—Paul R. Gilliam
*Assistant Examiner*—Victor N. Sakran
*Attorney, Agent, or Firm*—J. Raymond Curtin

[57] ABSTRACT

A cabinet construction for a ceiling-mounted fan-coil unit of an air conditioning system, the cabinet construction comprising a first cabinet section attachable to the fan-coil unit for housing a first portion of the unit, and a second cabinet section attachable to the first cabinet section for housing a second portion of the fan-coil unit, the two cabinet sections being attached by means of a latch assembly which assures the safe and proper installation of the two cabinet sections on the fan-coil unit.

7 Claims, 2 Drawing Figures

CABINET CONSTRUCTION

BACKGROUND OF THE INVENTION

1. Field of the Invention

The present invention relates to cabinet constructions, and in particular to multi-part cabinet constructions for housing ceiling-mounted fan-coil units of air conditioning systems.

2. Description of the Prior Art

Various types of machinery are provided with cabinets for safety, functional and asthetic purposes, and it is important that such cabinets be secured to the components which they house so that the cabinet cannot fall or be inadvertently removed from the interior structure. Not only would such removal obviate the purpose for which the cabinet was provided, but the cabinet could injure persons or damage property should such removal occur. This is particularly true in the case of cabinets for fan-coil units of air conditioning systems which are mounted in some elevated position such as from a ceiling. The cabinets for ceiling-mounted fan-coil units are conventionally secured to the fan-coil unit by means of bolts which extend through the cabinet to receptacles in the fan-coil unit. Such bolts are unattractive, and resort must be had to attractively plated bolts or decorative coverings to hide their otherwise unattractive appearance. The use of simple tabs or the like as might be acceptable for floor-mounted units cannot safely be used for units in elevated positions, because of the great risk of damage and injury which could result from a cabinet being removed from the unit, especially in situations where the cabinet was not properly secured to the unit. Moreover, the installation of a bulky housing over an elevated machine is a particularly cumbersome operation when a number of bolts must be used to secure the housing in place; more than one person is generally necessary to perform the job.

The problem of a safe yet economical cabinet construction is particularly involved in the case of fan-coil units which are susceptible of being mounted in either the vertical or horizontal positions, especially when the size of the components to be housed varies according to the orientation of the unit. In the case of a fan-coil unit which requires one size of cabinet when oriented in one position, and a larger cabinet when oriented in a different position, it would be advantageous to use a common size cabinet component for the smaller size and to provide a supplemental cabinet section to be attached to the basic cabinet when the fan-coil unit is oriented such that it calls for the larger cabinet. For example, in the situation where a fan-coil unit is constructed for mounting in a vertical position, it would be convenient to provide a basic cabinet for housing the fan-coil unit, and a set of legs or other support means forming part of the cabinet construction. When such fan-coil unit is mounted in its horizontal position such as from a ceiling, it would be advantageous to provide the basic cabinet for housing the main part of the fan-coil unit, and a supplemental cabinet section for housing those components peculiar to the latter position. Although it is advantageous to use such a multi-cabinet construction for the foregoing type of fan-coil unit when the unit is in its horizontal position, the difficult problem is presented of assuring that the cabinet sections are securely attached to the fan-coil unit and that they cannot be inadvertently and improperly so attached.

SUMMARY OF THE INVENTION

An object of the present invention is to provide an improved cabinet construction for securing a cabinet to a machine in a manner such that the cabinet is prevented from being inadvertently removed from the machine.

A more particular object of the present invention is to provide a cabinet construction for a ceiling-mounted fan-coil unit of an air conditioning system which, when secured to the fan-coil unit, cannot be unintentionally removed therefrom.

Another object of the present invention is the provision of a cabinet for housing a fan-coil unit, the fan-coil unit having alternative vertical and horizontal operating positions.

Yet a further object of the present invention is to provide a multi-part cabinet for a fan-coil unit which is only susceptible of a proper and safe attachment of the cabinet to the unit.

Yet another object of the present invention is to provide a latching device for securing the parts of a multi-part fan-coil unit cabinet to each other and to the fan-coil unit which they house, in a manner which assures the proper attachment of the parts.

Another object of the invention is the provision of a cabinet construction of the foregoing type which can be easily yet safely installed either in a factory or in the field, and which can readily be removed in the field by a technician or mechanic to render the fan-coil unit accessible for maintenance or repair.

A general object of the invention is to provide a cabinet construction of the foregoing type which is attractive, effective and efficient, and which is economical to fabricate and install.

Other objects will be apparent from the description to follow and from the appended claims.

The foregoing objects are achieved according to a preferred embodiment of the invention by the provision of a cabinet assembly constructed to house a ceiling-mounted fan-coil unit, the latter being of the type which is susceptible of both a freestanding, vertical mode of operation, and a ceiling-mounted, horizontal mode. The cabinet assembly comprises a base unit cabinet section constructed to detachably engage and house the fan-coil unit when the latter is in either of its vertical and horizontal positions. In the former situation, the base unit cabinet section is secured to the fan-coil unit by means of tabs in the cabinet which extend through slots in the fan-coil unit; and a pair of pedestals are attached to the cabinet and extend from the lowermost portion of the cabinet (which is supported by the fan-coil unit and spaced from the floor) to the floor. When the fan-coil unit is to be ceiling-mounted in a horizontal position, an extension for supporting and locating the wiring and piping associated with the fan-coil unit is attached to an end of the fan-coil unit. A pair of latch assembly members are bolted to the end of the fan-coil unit to which the extension is attached through one of a pair of holes in each of the respective latch assemblies. The base unit cabinet section is attachable to the ceiling-mounted fan-coil unit by means of the same tab and notch arrangement as used in the vertical mode, and the air inlet cabinet section is attachable about the foregoing extension to the fan-coil unit by bolts which extend through the walls of both cabinet sections. The latch assembly configurations locate the cabinet sections relative to the fan-coil unit, such that the tabs of the base unit cabinet section are disposed in the notches of the fan-coil unit, and the two cabinet sections can only be secured to the fan-coil unit if corresponding bolt holes in abutting surfaces of the cabinet sections are aligned with holes in the latch assemblies. When the bolts are inserted through the aligned holes of the cabinet sections and the latch assemblies, the cabinet assembly is safely secured to the fan-coil unit.

DESCRIPTION OF THE PREFERRED EMBODIMENT

The cabinet construction according to the preferred embodiment comprises a base unit cabinet section for housing the base unit of a fan-coil unit adaptable for operation in either the vertical, freestanding mode, or the horizontal, ceiling-mounted mode. When the fan-coil unit is in its freestanding mode, a support frame of the unit is supported on four adjustable legs, and the base unit cabinet section rests upon and houses the components of the fan-coil unit. The base unit cabinet section is held in place by means of tabs which extend through appropriate notches in the fan-coil unit being housed. A set of removable pedestals are attached to the base unit cabinet section for hiding the legs from view. In order to mount the fan-coil unit to a ceiling, it is placed in a horizontal position, and an extension for supporting the electrical and refrigerant lines is attached to an end of the unit. The modified fan-coil unit is then bolted to the ceiling. An air inlet section for housing the preceding extension is attached to the base unit cabinet section. The assembled cabinet sections are positioned about the fan-coil unit so that the respective cabinet sections house the corresponding portions of the fan-coil unit. With one end of the cabinet held on the fan-coil unit by means of the above-mentioned tabs and notches, the cabinet sections are positioned by means of a pair of latch assemblies which function to locate the cabinet sections relative to the fan-coil unit to hold the tabs in the notches, and bolts are placed through the cabinet sections and the latch assemblies to assure the safe connection of the cabinet sections to the fan-coil unit.

Figure 1:
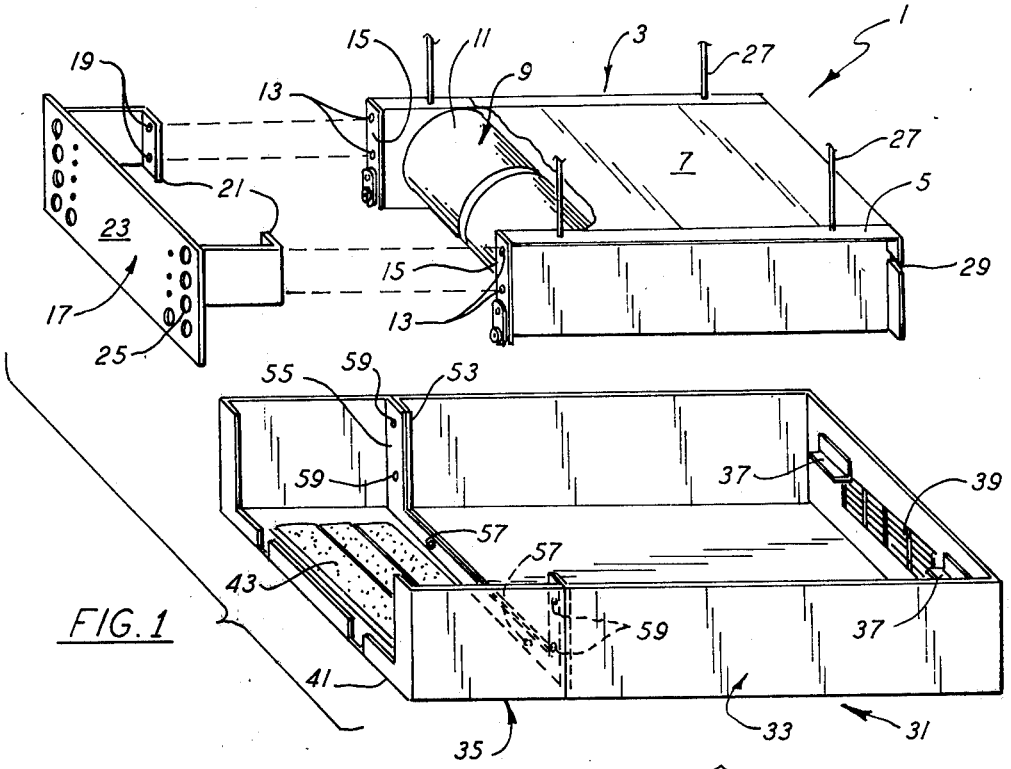
FIG. 1 is an exploded perspective view of a cabinet construction according to the invention as assembled to a ceiling-mounted fan-coil unit.

Referring now to FIG. 1, there is depicted a fan-coil unit 1 having a base unit 3 whose essential components are a support frame 5, a cooling coil forming part of the refrigerant circuit of an air conditioning system and supported by frame 5 beneath an insulating wall 7, and a set of fan or blower assemblies 9 each including a fan wheel rotatably mounted in a scroll 11 whose respective outlets direct air across the coil for discharge into the space being air conditioned.

Base unit 3 can alternatively be operated in a vertical position in which case it is supported on removable legs which extend through bolt holes 13 on end flanges 15 of frame 5, or in the horizontal position as described herein. When the fan-coil unit is to be attached to a ceiling, the legs are removed from holes 13, and a back panel 17 in the form of an extension to frame 5 is bolted to the frame by means of bolts inserted through bolt holes 19 in end flanges 21 of panel 17 and bolt holes 13 in frame 5. The forward wall 23 of back panel 17 is provided with a set of holes 25 through which extend electrical leads and coolant conduits connected to the inlet and outlet tubes of the cooling coil. Back panel 17 is most easily connected to frame 5 prior to the mounting of the fan-coil unit to the ceiling. The latter is accomplished by securing fan-coil unit 1 to mounting brackets in the ceiling by means of bolts 27.

A cabinet assembly 31 is provided to house fan-coil unit 1 for the purposes of protecting the fan-coil unit, of directing the flow of air from and into the fan-coil unit, and of enhancing the appearance of the unit. Cabinet assembly 31 comprises a base unit cabinet section 33 and an air inlet cabinet section 35. Base unit cabinet section 33 houses base unit 3, and for both the vertical and horizontal orientations of the base unit, cabinet section 33 is connectable to base unit 3 by means of interior cabinet tabs 37 which are insertable into notches 29 in frame 5 of base unit 3. When base unit 3 is in its freestanding mode supported on legs extending through flanges 15, base unit cabinet section 33 rests on fan-coil unit 1, and tabs 37 are located in notches 29 to hold cabinet section 33 in place. In this mode, cabinet section 33 must be moved vertically to install or remove it, and the risk of cabinet section 33 being inadvertently removed from base unit 3 is small (and the likelihood of damage is slight even if the cabinet section were so removed).

In order to house fan-coil unit 1 when operated in the horizontal, ceiling-mounted mode, a unitary cabinet could be provided which would be large enough to house both base unit 3 and back panel 17. Although such an arrangement would be practicable, all of the disadvantages associated with manufacturing, storing and assemblying two rather large cabinet sections would be experienced. Therefore, it has been found advantageous to utilize base unit cabinet section 33 for housing base unit 3, and an extension to cabinet section 33 in the form of air inlet section 35 for housing the additional components of fan-coil unit 1 which are incorporated therein when the unit is in the horizontal mode. Although resort to such a cabinet accessory is economically advantageous, certain problems are presented relating to the proper assembly of both cabinet sections to the horizontal fan-coil unit, and to the risk of such sections falling and causing injury or property damage. It is the avoidance of such problems which are the subject of this invention.

As indicated earlier, one purpose of the cabinet assembly is to facilitate the flow of air across the cooling coil of fan-coil unit 1. Accordingly, an opening in cabinet section 33 must be provided at the air discharge end of fan-coil unit 1 to admit cool air into the space being air conditioned. When fan-coil unit 1 is disposed on a floor or in a position where objects could be inserted into such opening, it is desirable to provide a protective grill across such air discharge opening. (The desirability of such a grill on a fan-coil unit which is not so accessible is less important.) Accordingly, an air discharge opening with a protective grill 39 thereacross is provided in cabinet section 33. An air inlet opening must be provided in the cabinet assembly for admitting air into fan-coil unit 1. When fan-coil unit 1 is in its vertical orientation, a base panel having an appropriate orifice is advantageously positioned across flanges 15 so that air can be drawn from near the floor and into scrolls 11.

When fan-coil unit 1 is ceiling-mounted, wall 23 of back panel 17 blocks the easy flow of air into scrolls 11 in the direction normal to the plane of flanges 15. Therefore, it is advantageous to provide an air inlet opening to fan-coil unit 1 in the bottom part of air inlet cabinet 35 as viewed from beneath the unit. Accordingly, air inlet section 35 defines an air plenum. The bottom wall 41 of section 35 is provided with an air inlet opening across which is located an air filter 43 for removing deleterious materials from air being drawn through the inlet opening.

Figure 2:
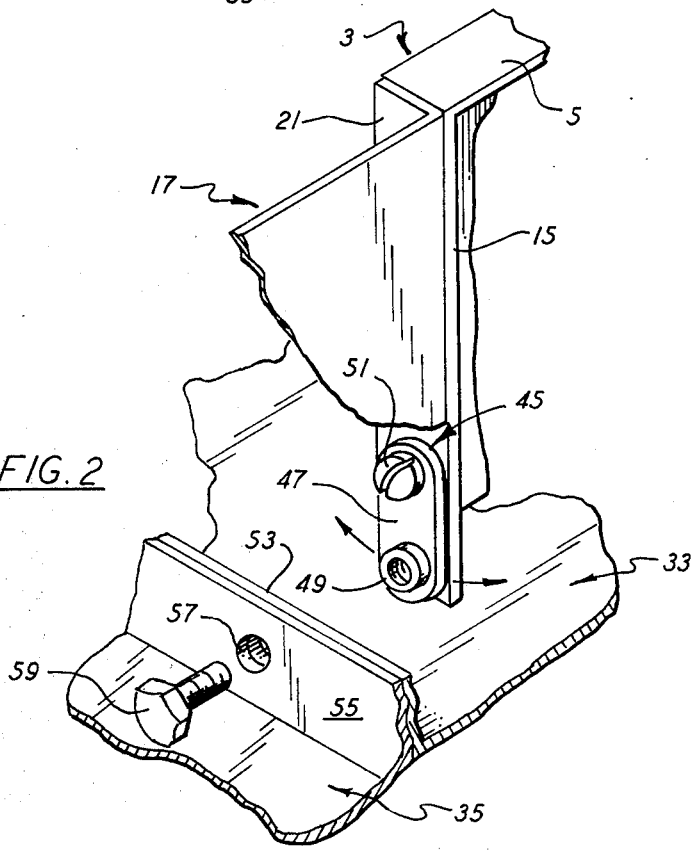
FIG. 2 is a detailed view of a portion of FIG. 1, illustrating one of the latch assemblies shown in FIG. 1.

As indicated herein, it is imperative that cabinet sections 33 and 35 be securely and properly mounted about fan-coil unit 1. Therefore, a pair of latch assemblies 45, one of which is shown in detail in FIG. 2, are provided. Each latch assembly 45 includes an elongate flat piece 47 having a pair of bolt holes one above the other, and a weldnut 49 fixed on piece 47, weldnut 49 having an identical bolt hole aligned with the lower bolt hole in element 47. Each latch assembly 45 is attached to frame 5 and back panel 17 by means of a pivot pin 51 in the form of a threaded bolt which extends through the upper bolt holes of each latch assembly 45 and a bolt hole in flange 15 beneath the lowermost of bolt holes 13. Latch assemblies 45 function to assure the proper and secure attachment of the two cabinet sections to fan-coil unit 1. Weldnut 49 serves as a spacer for positioning cabinet sections 33 and 35 relative to frame 5 and to preclude the displacement of cabinet section 33 so as to remove tabs 37 from notches 29. The distance between the outward face of weldnut 49 and the back surface of element 47 is equal to the depth to which tabs 37 enter notches 29. Cabinet sections 33 and 35 are provided with corresponding flanges 53 and 55, respectively, having locating surfaces which abut one another when the cabinet sections are assembled together. Flanges 53 and 55 are provided with a pair of holes, identified herein by the numeral 57, of like diameter and in alignment when flanges 53 and 55 are in opposed abutment. A pair of bolts 59 are each insertable into one set of aligned holes 57 and into the bolt hole extending through weldnut 49 of latch assembly 45, to secure both cabinet sections in place. Bolts 59 support most of the weight of the cabinet sections and must be selected with sufficient strength to serve this function. It is important to note that unless bolts 59 are properly inserted through each of cabinet sections 33 and 35 and weldnut 49, cabinet sections 33 and 35 will immediately start to fall from the fan-coil unit, so that the cabinet sections cannot be inadvertently assembled with the appearance of being properly positioned when in fact they are not. There is, thus, no danger of cabinet sections 33 and 35 falling after they are bolted in place.

In order to assemble cabinet sections 33 and 35 on a ceiling-mounted unit, each of latch assemblies 45 are bolted by bolt 51 with sufficient looseness so that the latch assemblies can be pivoted about each bolt 51. Then, cabinet sections 33 and 35 are connected together by the insertion of bolts (not shown) through corresponding bolt holes 57 which are of like diameter and in alignment when flanges 53 and 55 are in opposed abutment. The cabinet assembly is then lifted and the air discharge end (in which grill 39 is located) is tilted upwardly and tabs 37 are inserted into notches 29. While tabs 37 are bottomed in notches 29, the assembled cabinet sections are pivoted about the tabs to swing the cabinet assembly over the fan-coil unit. While the assembled cabinet sections are held in place, the workman reaches through the air inlet opening (filter 43 being loosely placed over the air inlet opening) and, after moving latch assemblies 45 to locate them relative to flanges 53 and 55, inserts each bolt 59 through holes 57 and into weldnut 49 of each latch assembly 45. If bolts 59 do not pass through weldnut 49, the cabinet assembly will immediately fall. When bolts 59 are properly inserted through the receiving holes, and tightened, abuting flanges 53 are drawn against weldnut 49 and the cabinet sections are firmly and safely held in place with tabs 37 disposed in notches 29. Bolts 51 can then be tightened, filter 43 dropped in place, and the assembly is finished.

Once assembled, the cabinet sections can be easily removed by removing bolts 59 to give access to the fan-coil unit for maintenance or repair; however, cabinet sections 33 and 35 cannot inadvertently be removed.

It is anticipated that cabinet sections 33 and 35 are fabricated from sheet metal using conventional manufacturing techniques. Likewise, it is anticipated that latch assemblies 45 comprise a stamped sheet metal piece 47 and a standard weldnut 49 welded thereto. However, latch assembly 45 could be a unitary item fabricated from any appropriate metal or other sufficiently strong material.

It can be seen from the foregoing description that each of the aforementioned objects of the invention have been achieved. The cabinet construction assures the proper and safe attachment of the cabinet sections to the equipment being housed. The base unit cabinet section can be used to house a fan-coil unit in either the horizontal or vertical positions. Each of the components relating to the cabinet construction can be made using conventional manufacturing techniques. The cabinet construction provided herein can easily yet safely be installed on a fan-coil unit or other apparatus in a factory or in the field, and can be removed in the field by a technician without having to be trained in special techniques.

The invention has been described in detail with particular reference to a preferred embodiment thereof, but variations and modifications may occur to those skilled in the art to which the invention pertains.

We claim:

1. A cabinet construction for housing a fan-coil unit, said cabinet construction comprising:

a first cabinet section dimensioned to house a first portion of the fan-coil unit, said first cabinet section having structure for engaging cooperating structure on the fan-coil unit to releasably hold said section on the fan-coil unit and a locating surface, a second cabinet section attached to the first cabinet section and dimensioned to house a second portion of the fan-coil unit latching means connected to the fan-coil unit for cooperating with said locating surface to position said cabinet sections to maintain said structure on said first cabinet section in engagement with said cooperating structure, and connector means for connecting said first and second cabinet sections to said latching means to cooperate with said structure on said first cabinet section to secure said cabinet sections to the fan-coil unit and to thereby prevent the inadvertant removal of said cabinet sections from the fan-coil unit.

2. The invention according to claim 1 wherein said structure on said first cabinet section and said cooperating structure comprise a tab and a notch for receiving said tab, and said latching means comprises a support piece and a spacer on said support piece, said spacer being dimensioned to engage said locating surface to maintain said tab disposed in said notch.

3. The invention according to claim 2 wherein said first and second cabinet sections and said latching means include alignable bolt holes, and said connector means comprises a bolt extending through said bolt holes to cooperate with said tab and notch to secure said cabinet sections to the fan-coil unit.

4. The invention according to claim 3 wherein said latching means comprises a plurality of latch members, each latch member comprising a generally flat member attached to the fan-coil unit for limited movement to align the bolt hole in the latch member with the corresponding bolt hole in said first and second cabinet sections.

5. The invention according to claim 1 wherein said second cabinet section comprises means defining an air plenum for admitting air to the fan-coil unit.

6. A cabinet construction for housing a ceiling-mounted fan-coil unit, the fan-coil unit having ground-facing and side surfaces and including a base unit section disposed generally parallel to the ground and having a heat exchange coil and a fan, and a back panel section extending from a juncture with the base unit section for supporting refrigerant conduits and electrical leads associated with the fan-coil unit, said cabinet construction comprising a base unit cabinet section dimensioned to house the ground-facing and side surfaces of the base unit section of the fan-coil, said base unit cabinet section including structure for engaging cooperating structure in the fan-coil unit to assist in positioning and attaching said base unit cabinet section on the base unit section of the fan-coil unit, and a surface transverse to the general plane of the base unit section disposed near the juncture of the base unit and back panel sections of the fan-coil unit, said transverse surface having at least one hole for receiving a bolt;

an air inlet cabinet section dimensioned to house the ground-facing and side surfaces of the back panel section of the fan-coil unit, said air inlet section defining an air plenum and having an opening for admitting air to the fan, and a surface in opposed relationship with said base unit cabinet section surface, the air inlet cabinet section surface having at least one hole alignable with said hole in said base unit cabinet section hole for receiving the bolt received by said last mentioned hole;

at least one latch member pivotally mounted on the fan-coil unit near the juncture of the base unit and back panel sections, said latch member including a spacer member for engaging one of said cabinet section surfaces when the structure of said base unit cabinet section is engaged with the cooperating structure of the fan-coil unit, to locate said cabinet sections relative to the fan-coil unit, and to maintain said structure and said cooperating structure in engagement, said spacer including a hole alignable with said alignable holes in said cabinet sections for receiving the bolt received by said alignable holes; and a bolt for each set of alignable cabinet section holes for extending through each set of aligned cabinet section holes and into the corresponding spacer member hole for attaching said cabinet sections to the fan-coil unit;

said latch member being accessible through the opening in said air inlet section to facilitate the attachment and removal of said bolt from said holes, for the assembly and dis-assembly of said cabinet sections from the fan-coil unit.

7. A cabinet construction for housing a fan-coil unit operatable in either a vertical, freestanding position or a horizontal, ceiling-mounted position, the fan-coil unit including a base unit section having a set of notches configured to receive a set of tabs and an extension attachable to the base unit section when the fan-coil unit is operated in the horizontal position for supporting conduits associated with the fan-coil unit, said cabinet construction comprising:

a base unit cabinet section for housing the base unit section of the fan-coil unit operating in either the vertical or horizontal positions, said base unit cabinet section having a set of tabs for entering the set of notches to connect the said base unit cabinet section to the base unit section, and an abutment surface;

an air inlet cabinet section for housing the extension to the fan-coil unit when the fan-coil unit is operated in the horizontal position, said air inlet cabinet section having an air plenum for admitting air to the fan-coil unit and an abutment surface for engaging the abutment surface of said base unit cabinet section, and said air inlet cabinet section and said base unit cabinet section being connected at said abutment surfaces and having a pair of aligned bolt holes extending through the respective abutment surfaces;

a pair of latch assemblies pivotally mounted on the fan-coil unit near said respective, aligned bolt holes when the fan-coil unit is in the horizontal position, each latch assembly including a flat support member and a spacer on the support member dimensioned to engage one of said engaged abutment surfaces to locate said cabinet sections to maintain the tabs in the notches, and a bolt hole alignable with the corresponding aligned bolt holes in said abutment surfaces; and a pair of bolts for extending through the aligned bolt holes in said abutment surfaces and in each latch assembly to cooperate with said tab in securing said cabinet sections to the fan-coil unit when the fan-coil unit is in the horizontal position.

* * * * *